US006247337B1

(12) United States Patent
Brandl

(10) Patent No.: US 6,247,337 B1
(45) Date of Patent: Jun. 19, 2001

(54) GRIPPING BREADTH HOLDERS IN A WARP KNITTING MACHINE

(75) Inventor: Klaus Brandl, Hainburg (DE)

(73) Assignee: Karl Mayer Textilmachinenfabrik GmbH, Obertshausen (DE)

( * ) Notice: Subject to any disclaimer, the term of this patent is extended or adjusted under 35 U.S.C. 154(b) by 0 days.

(21) Appl. No.: 09/575,306

(22) Filed: May 19, 2000

(30) Foreign Application Priority Data

May 28, 1999 (DE) ..... 199 24 587

(51) Int. Cl.[7] ..... D04B 15/88
(52) U.S. Cl. ..... 66/152; 66/149 R; 66/147
(58) Field of Search ..... 66/147, 148, 149 R, 66/150, 152; 139/304, 307; 87/31; 26/97

(56) References Cited

U.S. PATENT DOCUMENTS 2,348,162 * 5/1944 Warner ..... 66/149 R
2,916,899 * 12/1959 Hepp et al. ..... 66/149 R
4,061,374 * 12/1977 Altmann ..... 66/149 R
4,140,574 * 2/1979 Justus ..... 66/149 R

FOREIGN PATENT DOCUMENTS

742504 * 6/1980 (SU) ..... 66/152

* cited by examiner

*Primary Examiner*—Danny Worrell
(74) *Attorney, Agent, or Firm*—Selitto & Associates, P. C.

(57) ABSTRACT

A warp knitting machine has across its working breadth in its working area a plurality of knitting tools and an adjacent fabric pull-off arrangement. A pair of gripping breadth holders between the working area and the fabric pull-off are located at both edges of a fabric path. Each of the gripping breadth holders have at least one driven wheel with a plurality of circumferential needles. The wheel is driven through a drive axis that is substantially parallel to the working breadth of the machine. The wheel is mounted to rotate about a wheel axis that is inclined at an inclination angle to the drive axis.

15 Claims, 2 Drawing Sheets

GRIPPING BREADTH HOLDERS IN A WARP KNITTING MACHINE

BACKGROUND OF THE INVENTION

1. Field of the Invention

The present invention relates to a warp knitting machine with a knitting mechanism in the work area and a subsequent fabric pull-off.

2. Description of Related Art

In known warp knitting machines it is customary to provide the fabric pull-off as close as possible to the working area. This proximity is sought because of space efficiency or, as in the case in the Raschel machine, because of the manner of the knitting technology. Even when the distance between the working area and the pull-off is only a few centimeters, for example, to 2 to 10 centimeters, the edges of the fabric path moves inwardly before reaching the pull-off point. The size of this shrinkage depends on the type of goods produced and is at its greatest in elastic fabric.

Accordingly, an object of the present invention is to provide means which are operative even in the smallest separation between the working area and the fabric pull-off to avoid or substantially hinder this intrusion of the fabric path edges.

SUMMARY OF THE INVENTION

In accordance with the illustrative embodiments demonstrating features and advantages of the present invention, a pair of gripping breadth holders is provided in a working area of a warp knitting machine. A plurality of knitting tools and an adjacent fabric pull-off arrangement is located in the working area across its working breadth. The pair of gripping breadth holders are between the working area and the fabric pull-off. The holders are located at both edges of a fabric path. Each of the gripping breadth holders has at least one driven wheel having a plurality of circumferential needles. The wheel is driven through a drive axis that is substantially parallel to the working breadth of the machine. The wheel is mounted to rotate about a wheel axis that is inclined at an inclination angle to the drive axis.

Preferably, on both sides of the fabric path, gripping breadth holders are located in the working area and the fabric pull-off area. The holder preferably have at least one drive wheel with needles provided around its circumference. The drive axis is substantially parallel to the working width of the machine and the axis of the wheel runs at an angle thereto.

These breadth holders, because of the course of the drive axis, have a very small dimension in the pull-off direction. They can therefore be located relatively close behind the knitting elements; and even when there is a very small space between the working area and the fabric pull-off area, they may be inserted.

Because of the angular positioning of the at least one wheel, the gripping of the needles into the fabric path and the rotation of the wheel carried with it, leads to a force component transverse to the pull-off direction and thus has a certain breadth stretching effect. This is substantially amplified when the least one wheel is driven, so that the tension of the fabric at the edge is raised and the width of the fabric path, when it reaches the first take-off roller of the fabric take-off mechanism, is substantially maintained.

It is advantageous if the breadth holder has between two and four wheels. On the one hand, this gives the opportunity to operate on a sufficiently wide breadth area and on the other hand, by axial displacement of the breadth holder. The operating breadth holder forces may be adjusted.

It is desirable that the angular positioning of the at least one wheel relative to the travel direction of the fabric path is adjustable. By adjusting the appropriate angular position, the desired edge tension may be adjusted.

In a preferred embodiment, it is provided that the carrier means has one axial bore which carries a drive shaft and at least one angled pocket which takes up a wheel. It is relatively simple to provide such a carrier body.

As coupling means between the drive shaft and the wheels, many different forms of construction are possible which take account of the different axial positions of the drive shaft and the wheels, for example universal joint couplings, elastic couplings, elastic shafts and the like. It is particularly advantageous that the drive shaft has axial grooves into which radial inwardly directed pegs of the wheels may extend. Such a coupling can be formed in an exceedingly small space.

It is also advantageous that the circumference of the wheels protrude from the angled pockets over at least 90° and that by alteration of the rotational setting of the carrier body, the effective transverse displacement of the needles of the wheels may be altered. This gives rise to further possibilities which have an influence on the width holding effect.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
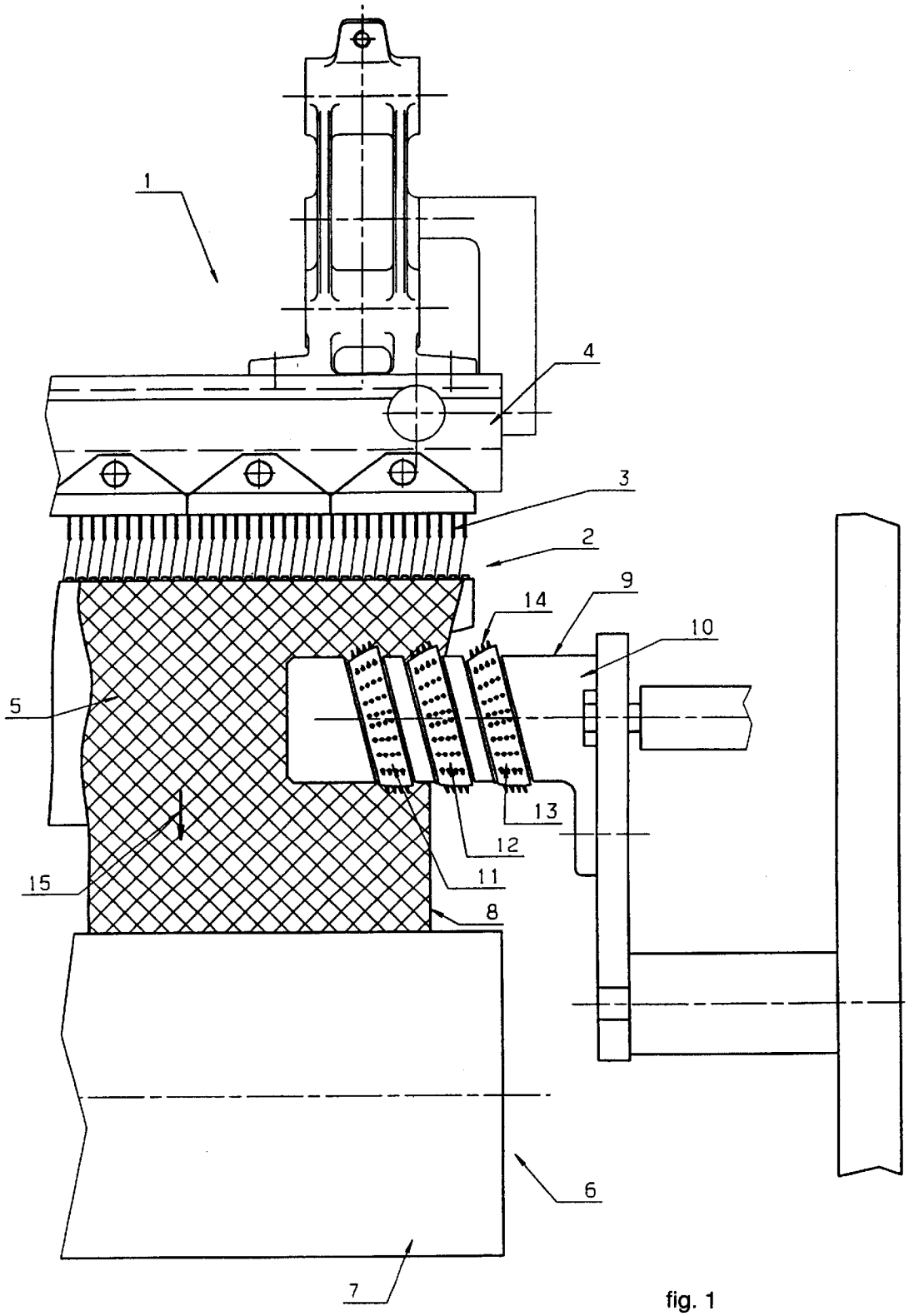
FIG. 1 is a schematic representation of the work and take-off area of a warp knitting machine in accordance with the present invention.

Referring to FIG. 1, a warp knitting machine (1) comprises a working area (2) in which the threads are laid over guides (3) from a guide bar (4). The working area comprises the usual knitting tools such as hook needles, slider needles, stitch comb sinkers, knock-over sinkers, and the like.

From the exit of the working area (2) a fabric path (5) emerges which is pulled over the fabric take-off (6) by a first roller (7) with a predetermined tension. The edge (8) of the fabric path (5) has the tendency to pull itself together in the transverse direction. Because of this, there is provided a breadth holder (9) whose carrier means (10) together with an unillustrated drive shaft, runs parallel to the working breadth of the warp knitting machine (1).

The carrier body (10) comprises three wheels (11, 12 and 13) provided on the circumference thereof with needles (14). These wheels are so driven that the portions of wheels (11, 12, 13) which are exposed in FIG. 1, grip into the fabric path (5) and move themselves substantially in the direction (15) of the movement of the fabric path (5), and even with substantially the same circumferential speed as the thread take-off means. However, because of the angular setting of the wheels, there is a substantial breadth holding tensioning, which may be adjusted by the adjustment of the angular setting appropriate for the particular fabric. Essentially the circumference of wheels (11, 12, and 13) around their place of tangency with the fabric path (5) have a component of motion along direction 15, and a component transverse thereto. This transverse component provides the breadth holding tensioning.

Figure 3:
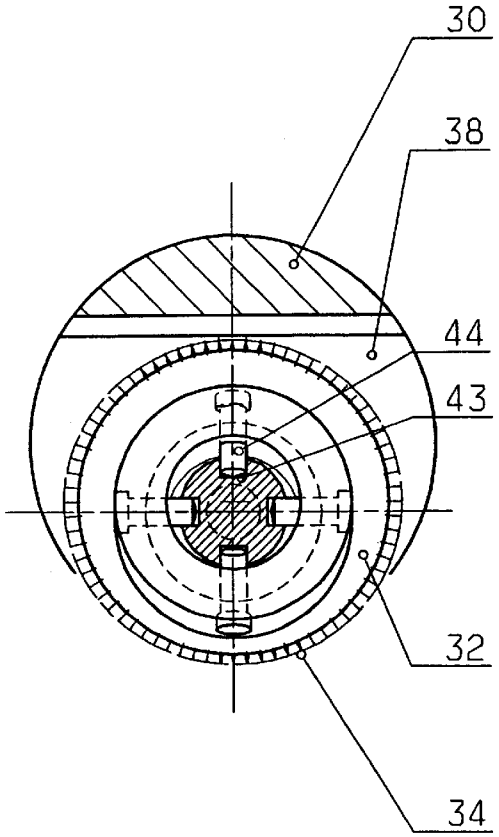
FIG. 3 is a cross-sectional view taken at line A—A of FIG. 2.
Figure 2:
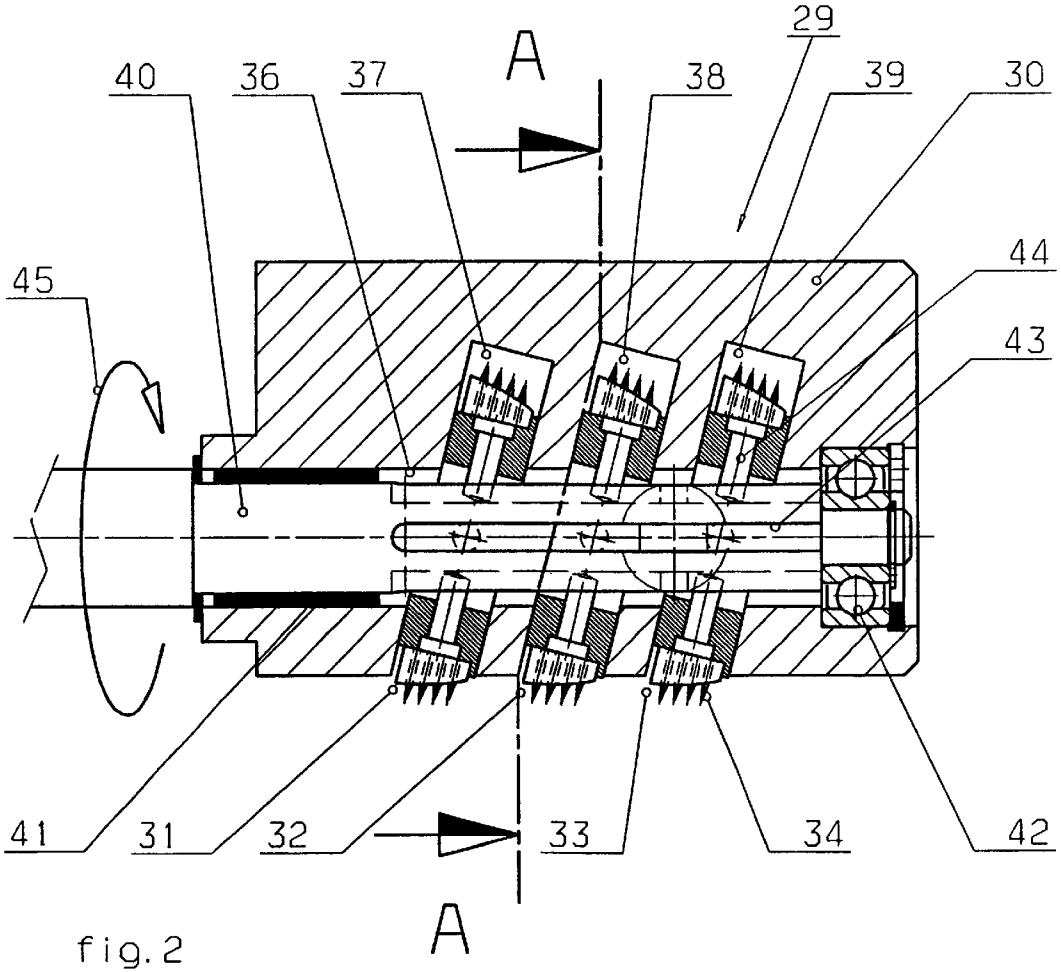
FIG. 2 is a cross-sectional view of a breadth holder that is an alternate to that of FIG. 1.

In the embodiments shown in FIGS. 2 and 3 whose components are indicated by raising the item number by 20 relative to those FIG. 1, the breadth holder (29) comprises a carrier body (30) with an axial bore (36) and three angled pockets (37, 38, 39). The axial bore carries a driven drive shaft (40), which is driven through its drive axis by drive means (45), and which is borne in guide bearing (41) and a roller bearing (42). Shaft (40) comprises four axial grooves (43). The pockets (37, 38, 35 39) each carry one wheel (31, 32, 33) which again are provided with needles (34).

The wheels comprise four radially and inwardly protruding pegs (44) which fit into the axial grooves (43). The pegs therefore transfer a turning moment, while allowing the wheels (31, 32, 33) to rotate in the tilted plane determined by pockets (37, 38, 39). The drive (45) may be provided by a dedicated motor, but preferably, it is taken off from the drive means of the fabric take-off.

The pockets (37, 38, 39) may, as shown in FIG. 3 for pocket 38, be formed as an angular groove by which the wheels (31, 32, 33) are thus oriented so that over a circumferential angle of at least 90°, they protrude outwardly out of the pocket (38). Thus, by rotating the carrier body (30) about the axis of the drive shaft (40), one may alter the direction in which pockets (37, 38, 39) tilt to thereby alter the plane of rotation of wheels (31, 32, 33) to effectively alter the amount of axial displacement of the needles (34) on the wheels.

The most desirable results are obtained when the distance between the working area (2) and the take-off (6) is of the order of 6–10 centimeters and three wheels are provided, which are driven at a circumferential speed which is equal to the fabric take-off speed, but can also be faster or slower when this is demanded by the fabric. Equally, the angular position of the wheels can be adjusted to the particular fabric pattern in order to obtain optimal result in the edge area.

Obviously, many modifications and variations of the present invention are possible in light of the above teachings. It is therefore to be understood that within the scope of the appended claims, the invention may be practiced otherwise than as specifically described.

What is claimed is:

1. In a working area of a warp knitting machine having across its working breadth a plurality of knitting tools and an adjacent fabric pull-off arrangement, a pair of gripping breadth holders between the working area and the fabric pull-off and located at both edges of a fabric path, each of the gripping breadth holders comprising:

at least one driven wheel having a plurality of circumferential needles and (a) being adapted to be driven through a drive axis that is substantially parallel to the working breadth of the machine, and (b) being mounted to rotate about a wheel axis that is inclined at an inclination angle to said drive axis.

2. In a warp knitting machine in accordance with claim 1, wherein the at least one driven wheel comprises between two and four wheels.

3. In a warp knitting machine in accordance with claim 1, wherein the wheel axis is adjustable in order to tangentially engage the fabric path at an engagement angle that is adjustable relative to the direction of movement of the fabric path.

4. In a warp knitting machine in accordance with claim 3, wherein each of the gripping breadth holders comprises:

a carrier body having an axial bore and at least one angled pocket; and a drive shaft mounted in said axial bore of said carrier body, the at least one driven wheel being rotatably mounted in the at least one angled pocket.

5. In a warp knitting machine in accordance with claim 3, wherein the drive shaft has a plurality of axial grooves, the at least one driven wheel having a plurality of radial and inwardly directed pegs fitting into the plurality of axial grooves.

6. In a warp knitting machine in accordance with claim 3, wherein the at least one driven wheel comprises between two and four wheels.

7. In a warp knitting machine in accordance with claim 1, wherein each of the gripping breadth holders comprises:

a carrier body having an axial bore and at least one angled pocket; and a drive shaft mounted in said axial bore of said carrier body, the at least one driven wheel being rotatably mounted in the at least one angled pocket.

8. In a warp knitting machine in accordance with claim 7, wherein the at least one driven wheel comprises between two and four wheels.

9. In a warp knitting machine in accordance with claim 7, wherein the drive shaft has a plurality of axial grooves, the at least one driven wheel having a plurality of radial and inwardly directed pegs fitting into the plurality of axial grooves.

10. In a warp knitting machine in accordance with claim 9, wherein the at least one driven wheel comprises between two and four wheels.

11. In a warp knitting machine in accordance with claim 1 wherein the at least one driven wheel protrudes from the at least one angled pocket exposing a circumferential region subtending an angle of at least 90° and by angular displacement of the carrier body the effective axial displacement of the needles of the wheels along the fabric path may be altered.

12. In a warp knitting machine in accordance with claim 3 wherein the at least one driven wheel protrudes from the at least one angled pocket exposing a circumferential region subtending an angle of at least 90° and by angular displacement of the carrier body the effective axial displacement of the needles of the wheels along the fabric path may be altered.

13. In a warp knitting machine in accordance with claim 7 wherein the at least one driven wheel protrudes from the at least one angled pocket exposing a circumferential region subtending an angle of at least 90° and by angular displacement of the carrier body the effective axial displacement of the needles of the wheels along the fabric path may be altered.

14. In a warp knitting machine in accordance with claim 9 wherein the at least one driven wheel protrudes from the at least one angled pocket exposing a circumferential region subtending an angle of at least 90° and by angular displacement of the carrier body the effective axial displacement of the needles of the wheels along the fabric path may be altered.

15. In a warp knitting machine in accordance with claim 11, wherein the at least one driven wheel comprises between two and four wheels.

* * * * *